US007748167B2

(12) United States Patent
Sommer et al.

(10) Patent No.: US 7,748,167 B2
(45) Date of Patent: Jul. 6, 2010

(54) DRIVE DEVICE

(75) Inventors: Frank-Uwe Sommer, Kirchheim (DE); Frank Sommer, Dettingen (DE)

(73) Assignee: Sommer Antriebs-und Funktechnik GmbH, Kirchheim (DE)

( * ) Notice: Subject to any disclaimer, the term of this patent is extended or adjusted under 35 U.S.C. 154(b) by 718 days.

(21) Appl. No.: 10/518,360

(22) PCT Filed: Jun. 5, 2003

(86) PCT No.: PCT/EP03/05901

§ 371 (c)(1),
(2), (4) Date: Jul. 21, 2005

(87) PCT Pub. No.: WO03/106797

PCT Pub. Date: Dec. 24, 2003

(65) Prior Publication Data

US 2006/0211847 A1 Sep. 21, 2006

(30) Foreign Application Priority Data

Jun. 17, 2002 (DE) ..... 102 27 110

(51) Int. Cl.
*E05D 15/38* (2006.01)
*E05F 15/10* (2006.01)

(52) U.S. Cl. ..... 49/358; 49/197; 49/199

(58) Field of Classification Search ..... 49/197, 49/199, 358

See application file for complete search history.

(56) References Cited

U.S. PATENT DOCUMENTS 1,981,026 A * 11/1934 Blodgett ..... 318/266
3,331,428 A 7/1967 Ford

FOREIGN PATENT DOCUMENTS

CH 678 964 A5 11/1991
DE 198 04 801 C1 7/1999
DE 198 08 696 A 8/1999

OTHER PUBLICATIONS

Office Action of Sep. 21, 2005 from European Patent Office and translation.
Russian Office Action of Mar. 6, 2006 and translation.
European Office Action dated May 18, 2006 issued in EP 05 011 657.3 with English translation.

* cited by examiner

*Primary Examiner*—Katherine W Mitchell
*Assistant Examiner*—Michael J Keller
(74) *Attorney, Agent, or Firm*—Venable LLP; Robert Kinberg; Steven J. Schwarz

(57) ABSTRACT

The invention relates to a drive device, particularly for doors, garage doors, etc., comprising a guide device, particularly a rail or guide rail, extending in movement direction of the door. The invention is characterised in that the feed means comprises a first insert body which can be plugged at the ends of the guide rail into this and is provided with a connecting cable and which is held at the guide rail end and constructed in such a manner that it fulfils its function not only at one end of the guide rail, but also at the other end of the guide rail.

10 Claims, 5 Drawing Sheets

DRIVE DEVICE

CROSS-REFERENCE TO RELATED APPLICATION

This application is a U.S. national-stage application based on PCT International Patent Application No. PCT/EP 03/05901, filed on Jun. 5, 2003, which draws priority from German Patent Application No. 102 27 110.0, filed on Jun. 17, 2002.

BACKGROUND OF THE INVENTION

The invention relates to a drive device according to the introductory part of claim 1.

In known devices of this kind the feed means can be formed as a drag cable or consists of a connecting cable and current conducting rails which are connected therewith and guided parallel to the guide rails and at which the current for the electric motor is taken off. Moreover, it is also known to arrange a traction means longitudinally in the guide rail and retain it at the ends thereof as well as to use this chain as current feed means for an electric motor which runs along on a carriage at a guide rail. The traction means in that case obtains the drive current for the electric motor by way of a tightening device mounted at one end of the guide rail for the traction means. The operation with a drag cable is very disturbing for the user, whilst in the cases of the current rail feed and the current-conducting traction means the current feed is possible only from one end of the guide rail, in the vicinity of which the mains socket necessary for the current feed is arranged. If the drive current is to be fed from the other end of the guide rail because the socket lies in the vicinity thereof, then the current feed at the guide rail has to be changed in expensive manner, if not even two embodiments of the guide rail are needed and have to be kept in storage.

SUMMARY OF THE INVENTION

The object of the invention consists in creating a drive device of the kind stated in the introductory part of claim 1 which makes it possible to use one and the same type of guide rail for the current feed not only from one end, but also from the other end of the guide rail without having to take into account substantial conversion operations for this freedom of choice.

This object is met by the features of claim 1.

The drive device according to the invention has the advantage that the guide rail can be adapted to the location of the socket which is present by mere replugging of the first insert body.

According to a further construction of the invention a second insert body without connecting cable is provided at the guide rail ends and able to be plugged into these, the construction of the second insert body otherwise corresponding with that of the first insert body and the second insert body being arranged at that guide rail end lying opposite the guide rail end provided for the first insert body.

A further construction of the invention relates to a drive device in which the current feed means comprises the guide rail itself and a traction means, which is connected at a guide rail end with a connecting cable by way of a traction means tightening device. This construction is characterised by the fact that the first insert body carries a contact body contacting the guide rail. The otherwise usual clamping connection of one cable connecting wire with the guide rail is thus avoided.

According to a further construction of the invention the first or second insert body comprises a first part carrying the traction means tightening device and a second part forming an encircling abutment for the guide rail end. The traction means can therefore be mounted in simple manner.

According to a further construction of the invention the first part and the second part are integrally connected together. The insert body can therefore be produced as a simple plastics material injection-moulded part.

According to a further construction of the invention the second part has bores serving for the ceiling, wall and lintel fastening of the guide rail. The insert body at the same time serves as a support point for the fastening of the guide rail.

BRIEF DESCRIPTION OF THE DRAWINGS

The invention is now explained in more detail by reference to an example of embodiment, wherein.

DETAILED DESCRIPTION OF EMBODIMENTS OF THE INVENTION

Figure 1:
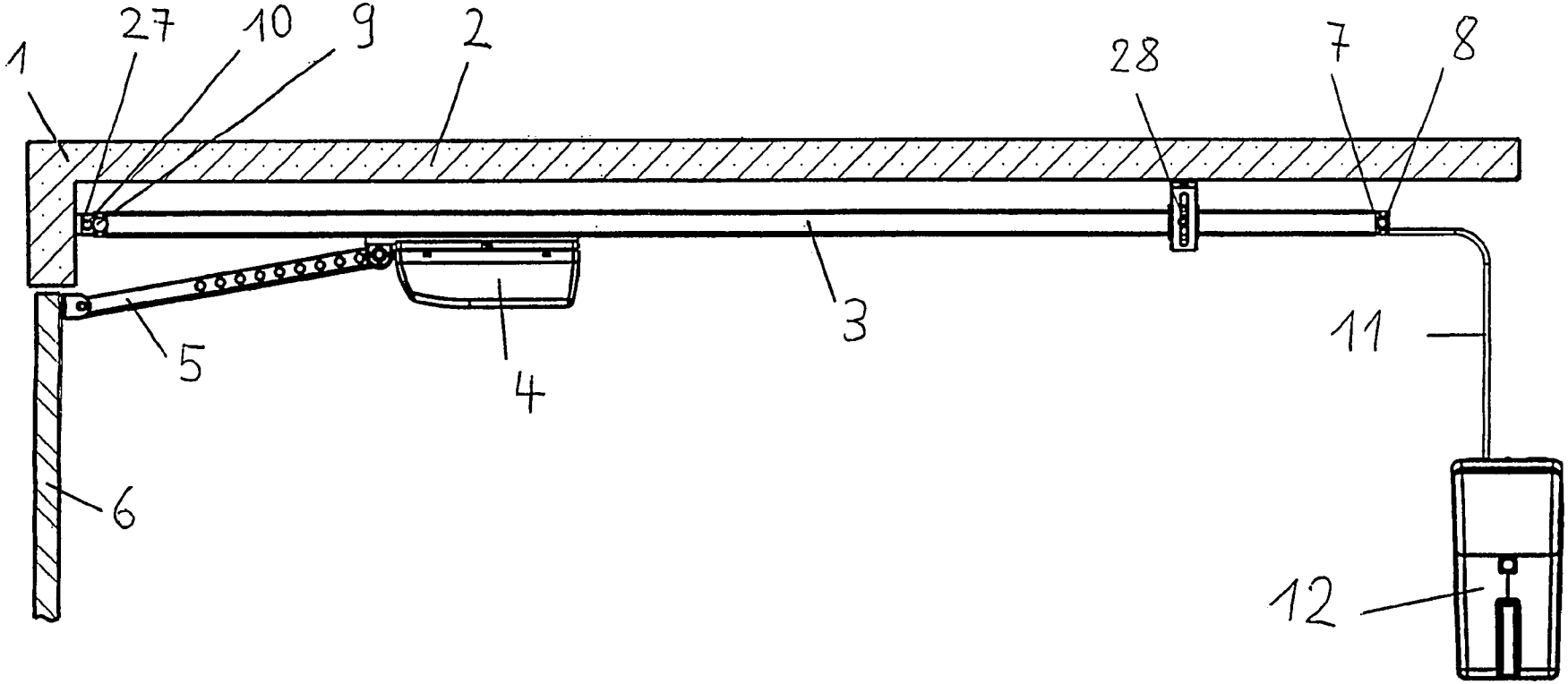
FIG. 1 shows a side view of a drive device according to the invention with a connection from the side remote from the door.

In FIG. 1 a part of a garage, namely a lintel 1 and a ceiling 2, is shown, to which a guide body—here a guide rail 3, preferably a rail which is C-shaped in cross-section, is fastened. A carriage 4 which is connected by way of a pivotably connected rod 5 with the door leaf 6 of the garage, runs at the guide rail. The end 7 of the guide rail 3 remote from the door leaf 6 is closed off by a first insert body 8 which can be plugged, whilst the end 9 of the guide rail 3 facing the door leaf 6 is closed off by a second insert body 10 which can be plugged. The first insert body 8 carries a current connecting cable 11 which opens at the other end into a control housing 12. The control housing 12 is plugged into a socket, which is not visible and which is arranged in the rearwardly disposed part of the garage.

Figure 2:
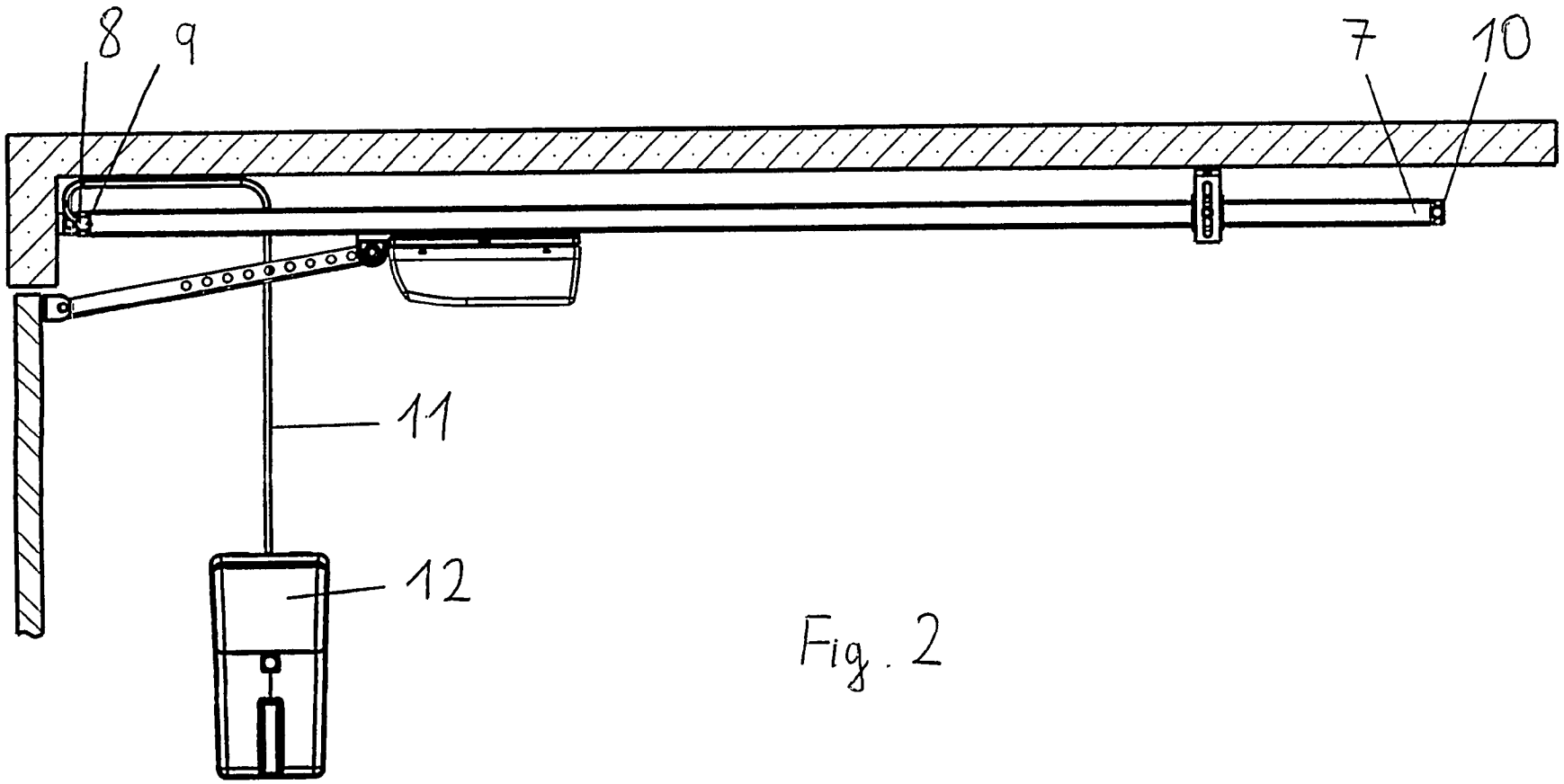
FIG. 2 shows a side view of a drive device according to the invention with a connection from the side facing the door.

In FIG. 2, which is similar to FIG. 1, the first insert body 8 and the second insert body 10 are interchanged after turning through an angle of 180°, so that now the end 9 is closed off by the first insert body 8 and the end 7 by the second insert body 10. In this case the control housing 12 is plugged into a socket, which is not visible and which is arranged in the forwardly disposed part of the garage.

Figure 3:
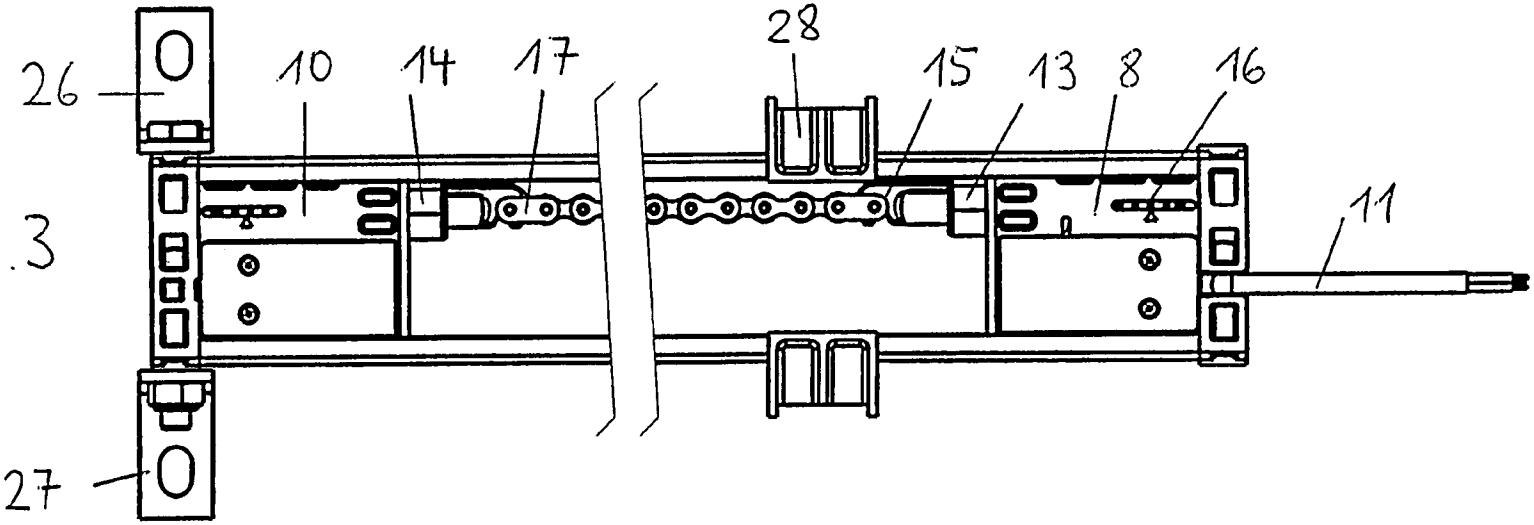
FIG. 3 shows an enlarged view of the guide rail, which is shown in FIG. 1, from below with insert bodies, connecting cable, traction means and rail fastening means.
Figure 4:
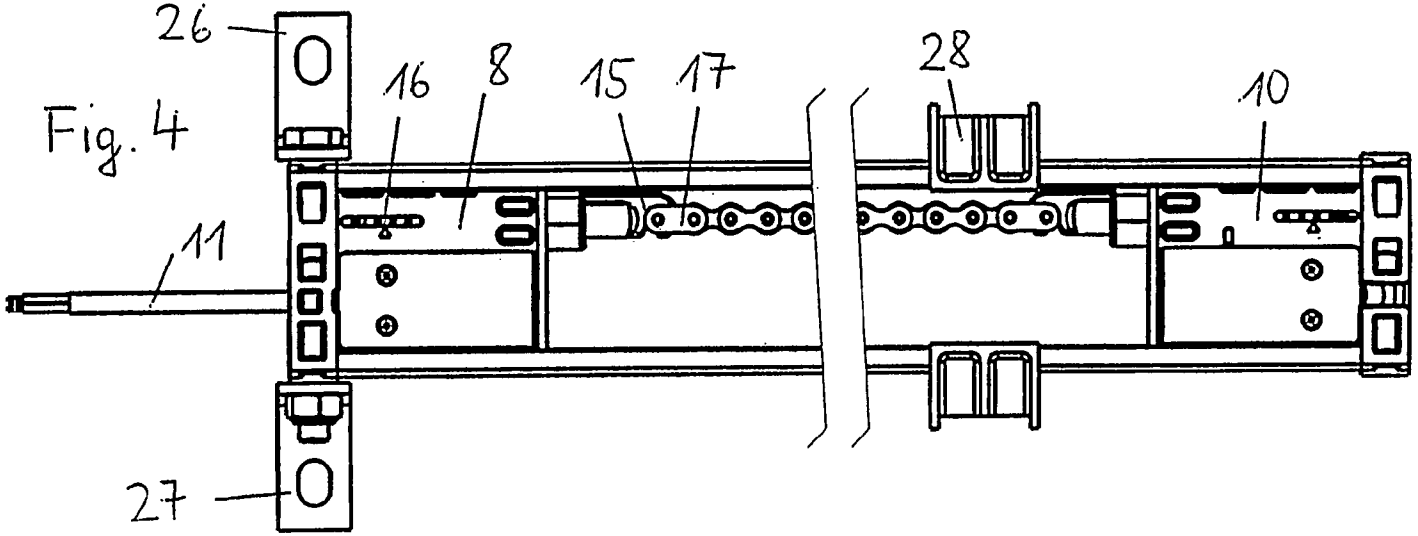
FIG. 4 shows an enlarged view of the guide rail, which is shown in FIG. 2, from below with insert bodies, connecting cable, traction means and rail fastening means.

In FIGS. 3 and 4 these two operating cases of FIGS. 1 and 2 are illustrated in more detail with respect to the guide rail 3, particularly profiled rails, wherein FIG. 3 is associated with FIG. 1 and FIG. 4 is associated with FIG. 2. In these figures the first insert body 8 has a traction means tightening device 13 and the second insert body 10 has a traction means tightening device 14, wherein these traction means tightening devices each comprise a respective hook or another part, which locks the traction means by mechanically positive couple, for example in bayonet-like manner, and allows tool-free fastening and detaching of the traction means without use of an additional traction means lock and which comprises an adjusting device adjusting the hook in rail longitudinal direction, as is shown, for example, in these FIGS. 3 and 4 by the hook 15 and the adjusting device 16. A traction means 17 is tightened between such hooks 16. The tightening device 13 and the traction means 17 are connected with a wire of the current feed cable 11. A gearwheel, which is not illustrated, of the electric motor arranged on the carriage 4 engages in the traction means 17, the drive winding of the electric motor thus obtaining current over the path covered.

Figure 5:
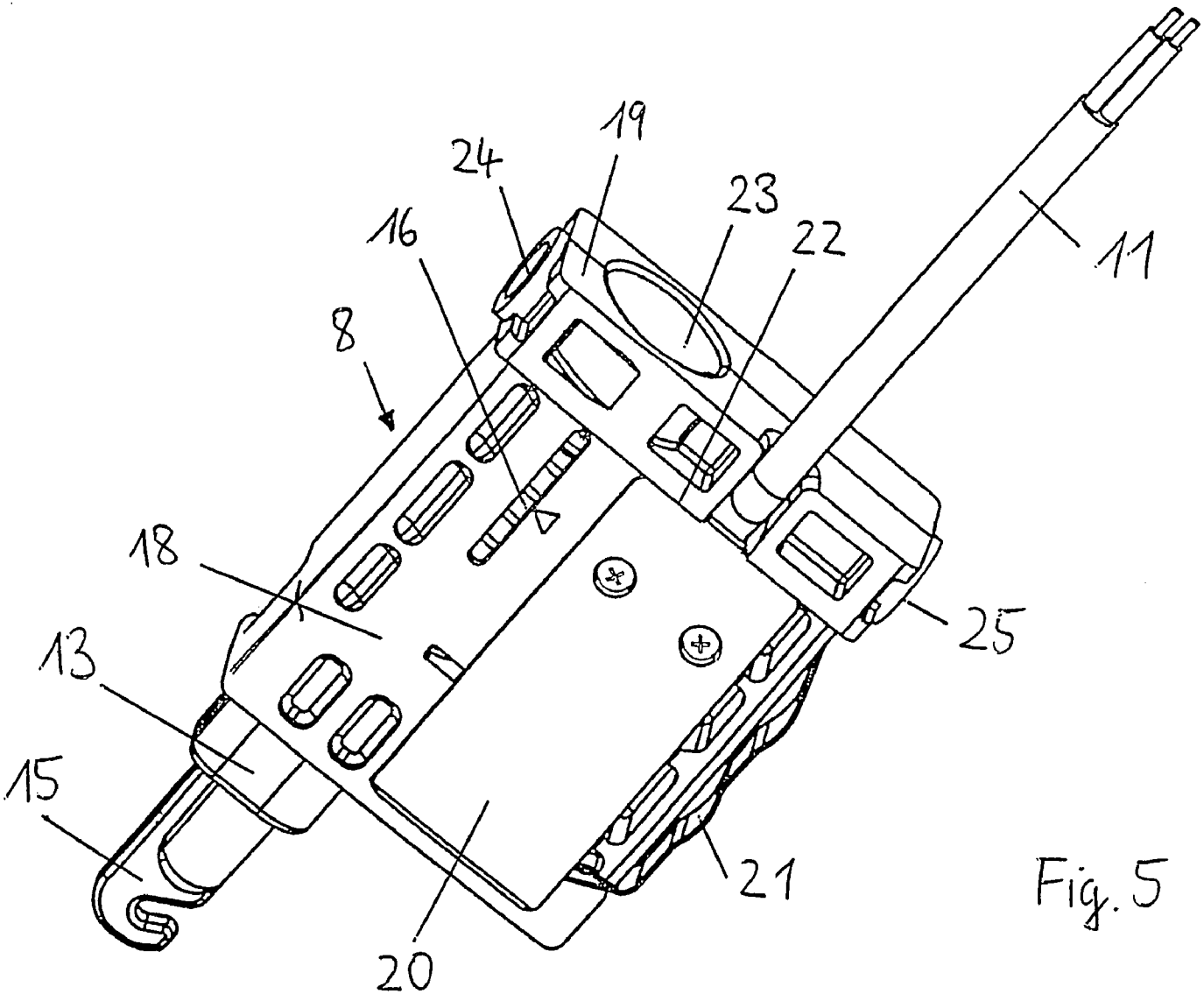
FIG. 5 shows an enlarged perspective view of a first insert body in use according to FIGS. 1, 3

The first insert body 8 is illustrated in more detail in FIG. 5. It consists of a substantially block-shaped body of two interconnected parts 18, 19 integrally produced from plastics material in the injection-moulding method.

The first part 18 carries the traction means tightening device 13 with the hook 15 and the adjusting device 16, a cover plate 20 also serving for retention relief of the current connecting cable 11 and, laterally, a contact 21 which is provided for the contacting of the other wire of the current connecting cable 11 with the guide rail 3, so that the drive winding of the electric motor is connected by its other pole with the connecting cable 11 over this path.

The second part 19 has a somewhat larger cross-section than the first part 18 and thus forms an encircling abutment 22 for retention of the plugged-in insert body 8 at the ends 7, 9 of the guide rail 3. The second part 19 has at the end face an opening 23 for access of the adjusting device 16 and, laterally, two bores 24, 25 which serve for fastening of the guide rail 3 to the lintel 1 (see FIG. 1). As FIGS. 3 and 4 show, this fastening can be carried out by means of brackets 26, 27. A further fastening point of the guide rail 3 is a bracket 28, which is fastened to the garage ceiling 2.

Figure 6:
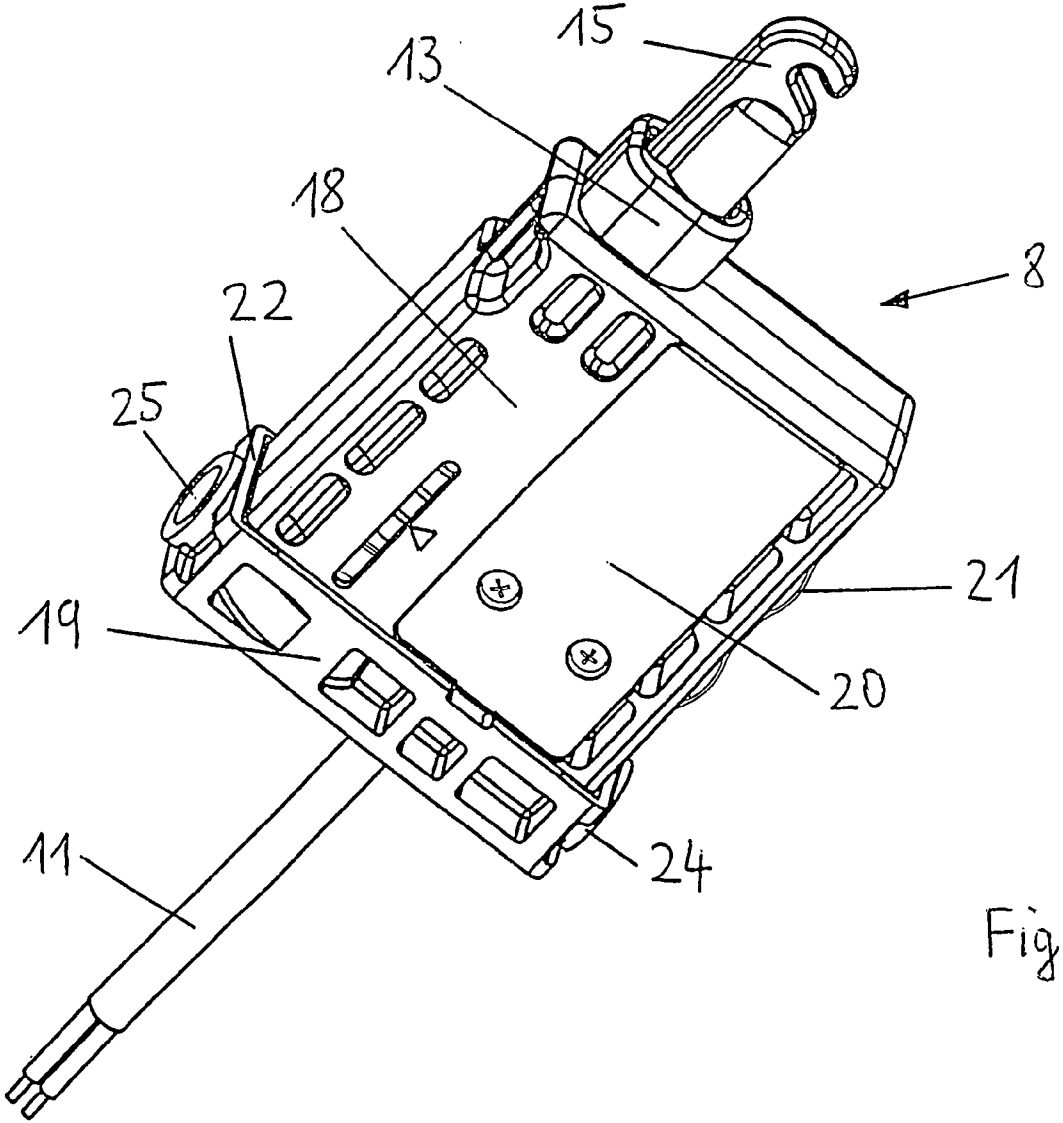
FIG. 6 shows an enlarged perspective view of a first insert body in use according to FIGS. 2, 4.

FIG. 6 shows the turned first insert body 8 at which the abutment 22 can be clearly recognised.

The second insert body 10 is preferably constructed just as the first insert body 8, but the connecting cable 11 is absent at it. In addition, the cover plate 20 and the contact 21 can be absent. Stock-keeping can therefore be confined to a single type of the insert body. In the case of change of the first insert body 8, the second insert body 10 is exchanged therewith.

What is claimed is:

1. A drive device for a door, comprising:

a guide rail extending in a movement direction of the door, the guide rail having a first end and a second end opposed from one another in the movement direction of the door;

a carriage which moves along said guide rail, the carriage comprising an electric motor, to cause movement of a door leaf, a first insert body configured and dimensioned to be interchangeably plugged into the first end of the guide rail and the second end of the guide rail, the first insert body comprising a first part having lateral walls that are dimensioned to plug into the first end or the second end of the guide rail, and a second part configured and dimensioned to abut the first end or the second end of the guide rail;

a current feed connecting the electric motor to a current source, the current feed comprising a current feed cable comprising a first lead and a second lead;

a traction mechanism;

a first traction mechanism tensioning device located on the first insert body, the first traction mechanism tensioning device including a first hook which locks the traction mechanism to the first insert body, and to release the traction mechanism from the first insert body without tools, wherein the first hook is coupled to the first lead of the current feed cable and delivers current from the current source to the traction mechanism;

a contact body positioned on at least one of the lateral walls of the first part of the first insert body, the contact body adapted to contact the guide rail, wherein the contact body is coupled to the second lead of the current feed cable and delivers current from the current source to the guide rail; and a second insert body configured and dimensioned to be interchangeably plugged into the first end of the guide rail and the second end of the guide rail, wherein the second insert body does not include a current feed cable or a contact body.

2. The drive device according to claim 1, wherein the first traction mechanism tensioning device is located on the first part of the first insert body.

3. The drive device according to claim 2, wherein the first part and the second part are integrally connected together.

4. The drive device according to claim 2, wherein the second part has bores to be used for fastening said guide rail.

5. The drive device according to claim 1, wherein the second insert body includes a second traction mechanism tensioning device with a second hook to lock into place the traction mechanism.

6. The drive device according to claim 5, wherein the traction mechanism is tensioned between the first traction mechanism tensioning device and the second traction mechanism tensioning device.

7. The drive device according to claim 5, wherein the guide rail forms a component of the current feed.

8. The drive device according to claim 7, wherein said first part of said first insert body carries the first traction mechanism tensioning device; and the second part of said first insert body has an opening to permit accessing an adjustment device of the first traction mechanism tensioning device.

9. The drive device according to claim 8, wherein said adjustment device enables the first hook of the first traction mechanism tensioning device to be adjusted in a longitudinal direction of the guide rail.

10. The drive device according to claim 1, wherein the traction mechanism comprises a chain.

* * * * *